US008987617B2

(12) United States Patent
Wang et al.

(10) Patent No.: US 8,987,617 B2
(45) Date of Patent: Mar. 24, 2015

(54) MULTICOLOR LIGHT-EMITTING COMPUTER INPUT DEVICE

(71) Applicant: Chicony Power Technology Co., Ltd., New Taipei (TW)

(72) Inventors: Pai-Hsiang Wang, New Taipei (TW); Kui-Chih Su, New Taipei (TW)

(73) Assignee: Chicony Power Technology Co., Ltd, New Taipei (TW)

( * ) Notice: Subject to any disclaimer, the term of this patent is extended or adjusted under 35 U.S.C. 154(b) by 320 days.

(21) Appl. No.: 13/680,826

(22) Filed: Nov. 19, 2012

(65) Prior Publication Data

US 2013/0306455 A1 Nov. 21, 2013

(30) Foreign Application Priority Data

May 17, 2012 (TW) ..... 101209348 U

(51) Int. Cl.

| | |
|---|---|
| ***H01H 9/26*** | (2006.01) |
| ***H01H 13/72*** | (2006.01) |
| ***H01H 13/76*** | (2006.01) |
| ***H01H 13/83*** | (2006.01) |
| *H01H 3/12* | (2006.01) |

(52) U.S. Cl.

CPC ..... *H01H 13/83* (2013.01); *H01H 3/125* (2013.01); *H01H 2219/014* (2013.01); *H01H 2219/06* (2013.01); *H01H 2219/062* (2013.01)

USPC ..... 200/5 A

(58) Field of Classification Search

CPC ..... H01H 9/26; H01H 13/72; H01H 13/70; H01H 25/00; H01H 25/04; H01H 13/76; H01H 1/56; H01H 1/02; H01H 1/10

USPC ..... 200/344, 5 R, 5 A, 5 B, 510–513, 520, 200/329, 337, 341, 345, 314

See application file for complete search history.

(56) References Cited

U.S. PATENT DOCUMENTS

| | | | | |
|---|---|---|---|---|
| 4,225,766 | A * | 9/1980 | Pfeifer et al. | 200/314 |
| 6,860,612 | B2 * | 3/2005 | Chiang et al. | 362/29 |
| 8,770,772 | B1 * | 7/2014 | Zhang | 362/23.03 |
| 2010/0108481 | A1 * | 5/2010 | Chiang | 200/310 |
| 2011/0297523 | A1 * | 12/2011 | Tsai | 200/5 A |

* cited by examiner

*Primary Examiner* — Edwin A. Leon
*Assistant Examiner* — Anthony R. Jimenez
(74) *Attorney, Agent, or Firm* — Muncy, Geissler, Olds & Lowe, P.C.

(57) ABSTRACT

A multicolor light-emitting computer input device includes a key switch module including a bottom plat having through holes, press members spaced above the bottom plate, and linking members respectively coupled between the bottom plate and the press members for moving the press members up and down, a circuit board arranged above the bottom plate and carrying light-emitting diodes in the through holes of the bottom plate and a light guide cap of a selected color capped around each light-emitting diode, elastomer members arranged the top side of the circuit board, and a light guide panel arranged at the bottom side of the bottom plate for receiving light from the light-emitting diodes and the respective light guide caps and guiding the received light toward the press members.

13 Claims, 9 Drawing Sheets

MULTICOLOR LIGHT-EMITTING COMPUTER INPUT DEVICE

This application claims the priority benefit of Taiwan patent application number 101209348, filed on May 17, 2012.

BACKGROUND OF THE INVENTION

1. Field of the Invention

The present invention relates to computer-input technologies and more particularly, to a multicolor light-emitting computer input device which uses light-emitting diodes with colored light guide caps to illuminate the press members thereof and keeps the light-emitting diodes far from the high temperature area of the electronic device using the multicolor light-emitting computer input device, thereby prolonging the lifespan of the light-emitting diodes, reducing the cost of maintenance, and avoiding affecting the feeling of user's hand during operation or any component deformation due to a long use.

2. Description of the Related Art

Following fast development of the modern technology and electronic industry, many different kinds of consumer electronics are created, bringing convenience to people. Most electronic devices are equipped with a keyboard, mouse, joystick or light gun for data or instruction input. Different key switch devices have been created for use in different electronic products. A computer keyboard for notebook has a different configuration when compared to a computer keyboard for desk computer. Because a notebook computer has light, thin, small and short characteristics, a computer keyboard for desk computer is not suitable for use in a notebook computer.

Further, the key switches of the keyboard of an early design notebook computer cannot give off light. A user may be unable to accurately click the key switches of the keyboard of a notebook computer under a dim light environment. To eliminate this problem, notebook computer keyboard capable of giving off light is created. As illustrated in FIGS. 8 and 9, a notebook computer keyboard capable of giving off light is known comprising a key switch structure A and a backlight device B. The key switch structure A comprises a bottom plate A1, a membrane circuit board A2 arranged at the top side of the bottom plate A1, a plastic thin film A3 disposed at the top side of the membrane circuit board A2 and carrying an elastomer A31, a key cap A5 spaced above the elastomer A31, and a linking member A4 coupled between the bottom plate A1 and the key cap A5. The backlight device B comprises a light guide panel B1 arranged at the bottom side of the bottom plate A1, and a light-emitting device B11 disposed at one lateral side of the light guide panel B1, and a light reflecting panel B2 arranged at the bottom side of the light guide panel B1.

During operation, the light-emitting device B11 emits light laterally into the light guide panel B1, and the light reflecting panel B2 reflects downwardly falling light from the light guide panel B1 toward the key cap A5 of the key switch structure A. However, because the light-emitting device B11 disposed at one lateral side of the light guide panel B1, the flat substrate C1 of the notebook computer C must provide a groove C11 in the keyboard accommodation chamber C0 thereof for accommodating the light-emitting device B11 and the related circuit layer so that the keyboard can be smoothly accommodated in the keyboard accommodation chamber C0 without damaging the light-emitting device B11. However, after installation of the light-emitting device B11 in the groove C11 in the keyboard accommodation chamber C0, the light-emitting device B11 is kept close to the internal component parts of the notebook computer C that produce heat during operation. In order to provide the groove C11 in the keyboard accommodation chamber C0, the thickness of the flat substrate C1 must be relatively increased (about 0.3 mm~0.5 mm). Increasing the thickness of the flat substrate C1 relatively increases the thickness of the product.

Further, the light-emitting device B11 may be arranged at the center area or a border area of the flat substrate C1. If the light-emitting device B11 is arranged at the center area of the flat substrate C1, the center area of the flat substrate C1 may be forced to sink when the user clicks the keyboard, affecting the user's feeling in the operating hand or causing component deformation.

Further, in order to fit the change in demand from users and to compete in the market, manufacturers keep creating different techniques, functions and products. In consequence, notebook computers using different materials or having different colors, shapes and/or surface treatments are continuously created and put on the market. However, regular light-emitting keyboards simply use white light-emitting diodes for giving off white light. For changing the color of light, a different color of light-emitting diodes shall be used. However, preparing different colors of light-emitting diodes (blue, green and/or red light-emitting diodes) relatively increases the manufacturer's inventory cost.

Therefore, it is desirable to provide a computer input device, which eliminates the drawbacks of the conventional designs.

SUMMARY OF THE INVENTION

The present invention has been accomplished under the circumstances in view. It is therefore the main object of the present invention to provide a multicolor light-emitting computer input device, which uses light-emitting diodes to illuminate the press members thereof and keeps the light-emitting diodes far from the high temperature area of the electronic device using the multicolor light-emitting computer input device, prolonging the lifespan of the light-emitting diodes, reducing the cost of maintenance, and avoiding affecting the user's feeling in the operating hand or any component deformation due to a long use.

To achieve this and other objects of the present invention, a multicolor light-emitting computer input device comprises a key switch module, which comprises a bottom plate having through holes, press members spaced above the bottom plate and linking members respectively coupled between the bottom plate and the press members for moving the press members up and down, a circuit board, which is arranged at the top side of the bottom plate, comprising light-emitting diodes electrically connected to a flexible printed circuit layer thereof and respectively inserted into the through holes of the bottom plate and a light guide cap capped on each light-emitting diode, elastomer members arranged the top side of the circuit board below the press members, and a light guide panel arranged at the bottom side of the bottom plate for receiving light from the light-emitting diodes and the respective light guide caps and guiding the received light toward the press members. By means of arranging the light-emitting diodes and the circuit board at the top side of the bottom plate, the light-emitting diodes and the circuit board are kept far from the high temperature area of the electronic device using the multicolor light-emitting computer input device, and waste heat can be dissipated through the bottom plate during operation of the multicolor light-emitting computer input device, prolonging the lifespan of the light-emitting diodes and reducing the cost of maintenance.

Further, the light-emitting diodes can be white light-emitting diodes, and the light guide caps can be made in one same color or different colors. Thus, the multicolor light-emitting computer input device can be selectively configured to give off different colors of light for illuminating the press members.

Further, by means of arranging the light-emitting diodes and the flexible printed circuit layer at the top side of the bottom plate, the planar support frame of the notebook computer that supports the multicolor light-emitting computer input device needs not to provide recesses for accommodating the light-emitting diodes and the flexible printed circuit layer, and therefore the planar support frame can be maintained having a flat, thin and uniform thickness to effectively support the multicolor light-emitting computer input device against any operating pressure, avoiding affecting the user's feeling in the operating hand or any component deformation due to a long use.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
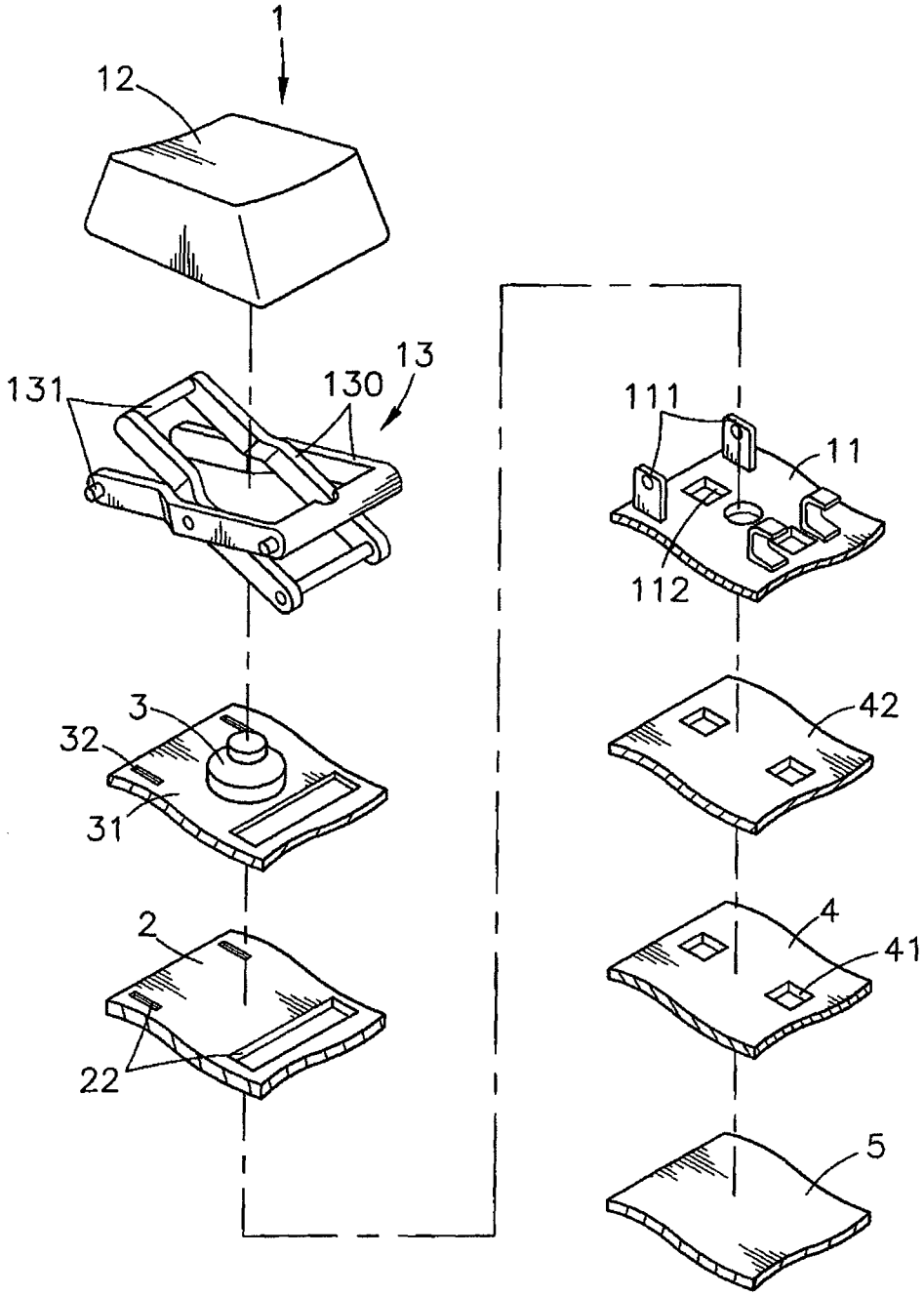
FIG. 1 is an exploded view of a multicolor light-emitting computer input device in accordance with the present invention.
Figure 2:
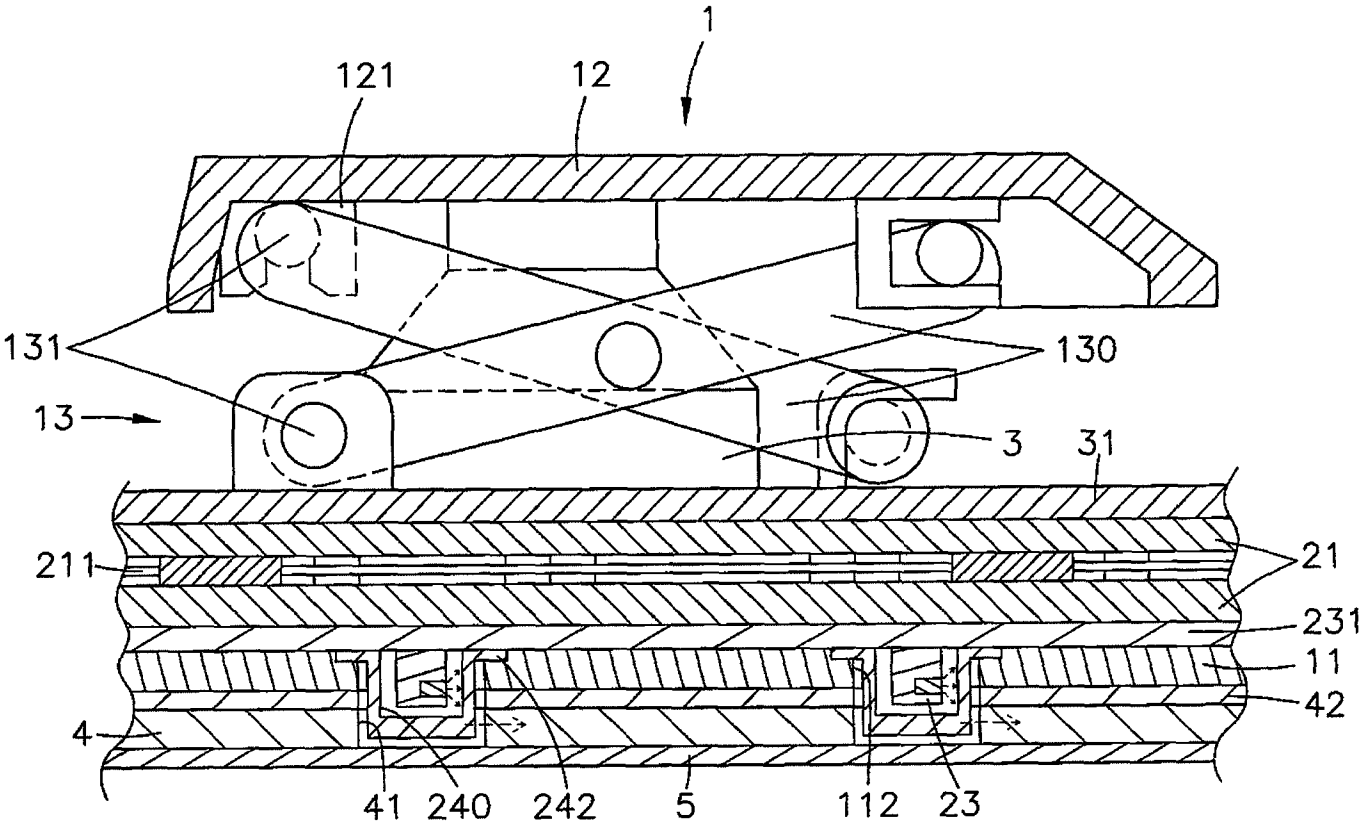
FIG. 2 is schematic sectional side view of the multicolor light-emitting computer input device in accordance with the present invention.
Figure 3:
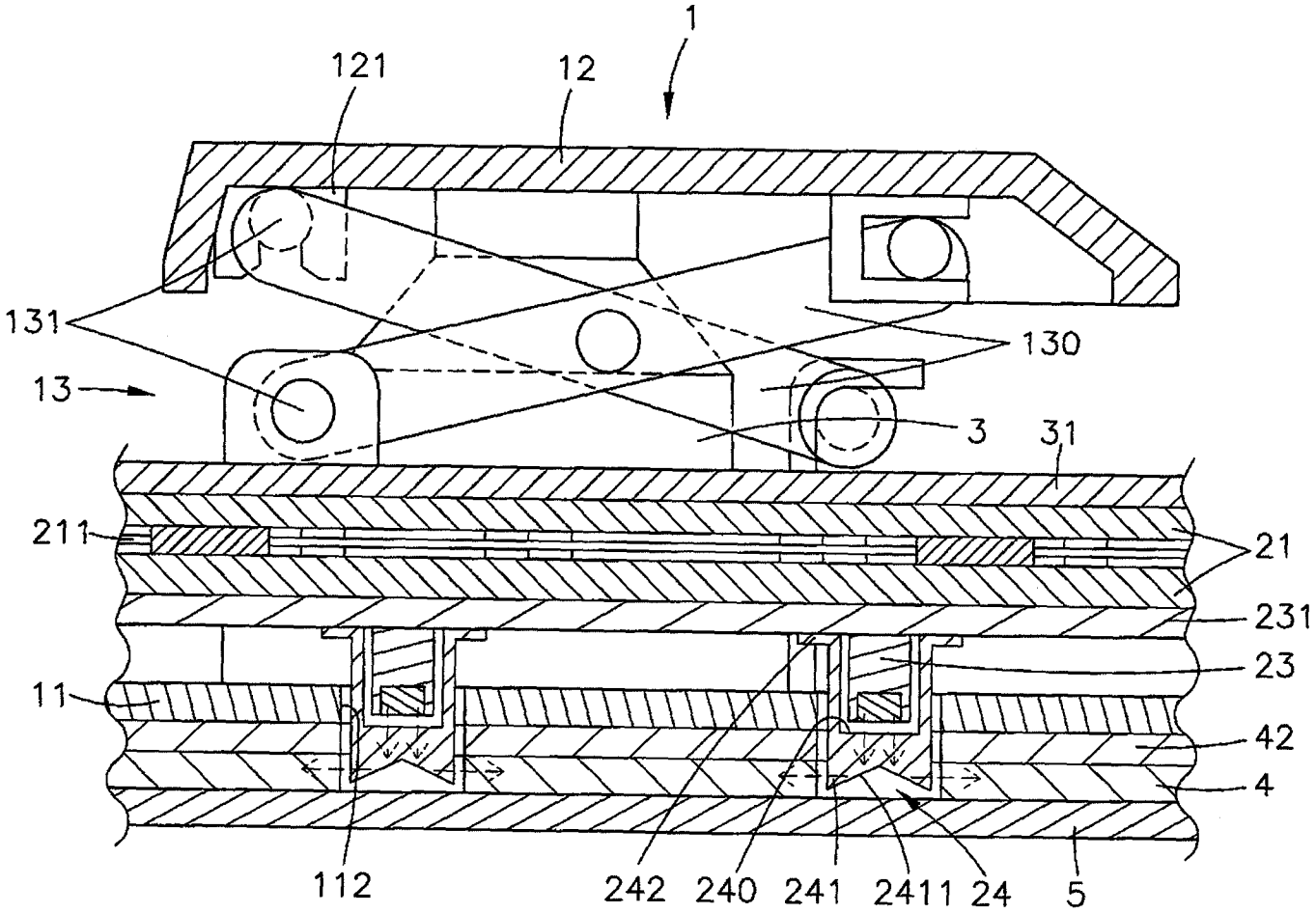
FIG. 3 is similar to FIG. 2 but showing different light guide caps used and capped on the respective light-emitting diodes.
Figure 4:
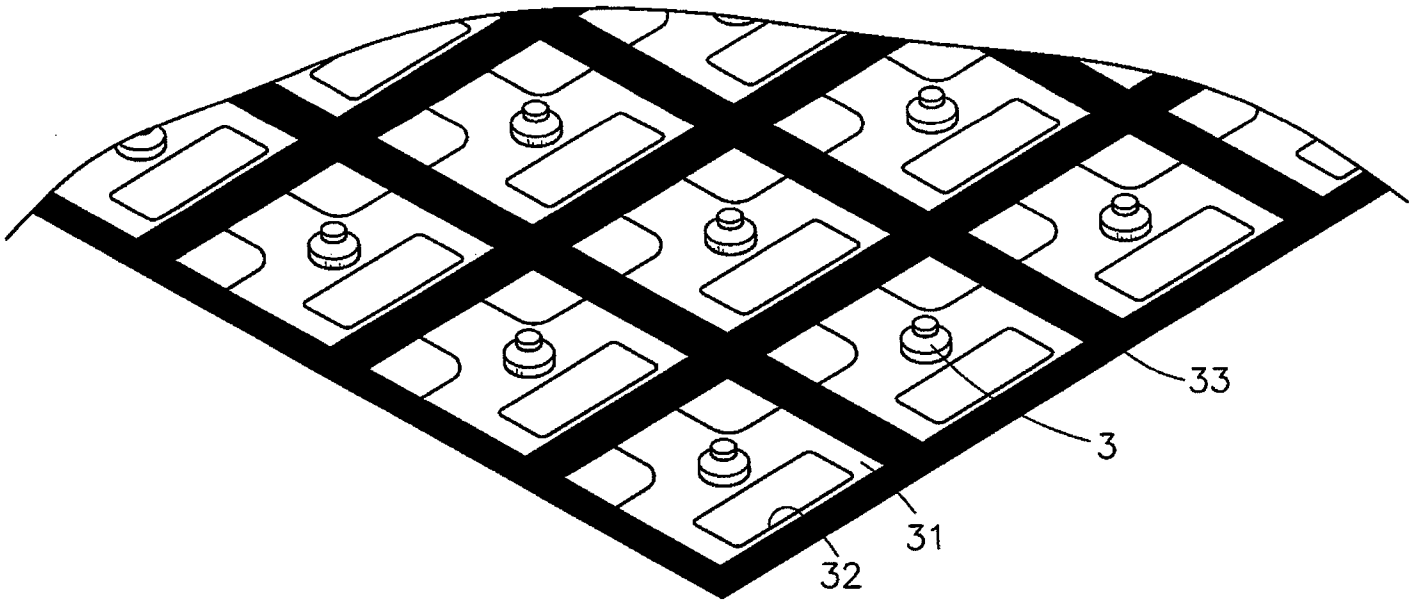
FIG. 4 is an oblique elevation of a part of the present invention, illustrating the arrangement of the shaded portion at the membrane around each elastomer member.

Referring to FIGS. 1-4, a multicolor light-emitting computer input device in accordance with the present invention is shown. The multicolor light-emitting computer input device comprises a key switch module 1, a circuit board 2, at least one elastomer member 3, and a light guide panel 4.

The key switch module 1 comprises a bottom plate 11 made of a metal or hard plastic material and having at least one set of upright coupling lugs 111 and at least one through hole 112, at least one press member 12 that can be made in the form of a key cap, thin metal sheet member or any other key member and spaced above the bottom plate 11 and having two coupling portions 121 bilaterally disposed at a bottom side thereof, and at least one linking member 13 respectively coupled between the bottom plate 11 and the at least one press member 12 for moving the at least one press member 12 up and down relative to the bottom plate 11. In this embodiment, each linking member 13 is a scissor link 130 having pivot portions 131 respectively pivotally coupled to the coupling portions 121 of one respective press member 12 and one respective set of upright coupling lugs 111. Preferably, the bottom plate 11 is made of a metal material having high thermal conductivity.

The circuit board 2 is arranged at the top side of the bottom plate 11. In this embodiment, the circuit board 2 is a membrane circuit board comprising two substrates 21 selected from the material group of polycarbonate, polyethylene terephthalate, and other flexible light transmissive sheet materials, a circuit layout 211 arranged between the two substrates 21, at least one set of through holes 22 cut through the substrates 21 for the passing of the at least one set of upright coupling lugs 111 of the bottom plate 11 of the key switch module 1 respectively, a flexible printed circuit layer 231 arranged at the bottom side of the substrates 21, at least one light-emitting diode 23 electrically bonded to the flexible printed circuit layer 231 corresponding to the at least one through hole 112 of the bottom plate 11 of the key switch module 1, and at least one light guide cap 24 respectively capped on the at least one light-emitting diode 23. Each light guide cap 24 defines therein an accommodation chamber 240 that accommodates one respective light-emitting diode 23. Further, each light guide cap 24 comprises a light outlet end 241 formed of the bottom and peripheral walls thereof, and a fixed end 242 formed of the top side thereof.

The at least one elastomer member 3 is arranged at the top side of the circuit board 2, having a membrane 31 formed integral with the bottom side thereof. The membrane 31 has at least one set of through holes 32 for the passing of the at least one set of upright coupling lugs 111 of the bottom plate 11 of the key switch module 1 respectively, and a shaded portion 33 around each elastomer member 3 corresponding to each press member 12.

The light guide panel 4 is arranged at the bottom side of the bottom plate 11 of the key switch module 1, defining at least one receiving hole 41 for receiving the light outlet end 241 of each of the at least one light guide cap 24 respectively.

When pressing one press member 12 of the key switch module 1 to lower the respective linking member 13, the elastomer member 3 will be compressed by the press member 12 against the circuit board 2, causing respective contacts of the circuit board 2 to be electrically closed to output a respective signal. When the user released the finger from the press member 12, the elastomer member 3 immediately returns to its former shape, forcing the respective linking member 13 to return the press member 12 to its former position. When the circuit board 2 is triggered by one press member 12 to output a respective signal, one respective light-emitting diode 23 is simultaneously driven to give off light. At this time, the light goes through the light outlet end 241 of the respective light guide cap 24 into the light guide panel 4, and is then guided by the light guide panel 4 through the respective through hole 112 of the bottom plate 11 of the key switch module 1 toward the respective press member 12.

As stated above, the linking member 13 in this embodiment is a scissor link 130. However, rotary shaft type linking design, sliding groove type linking design, or any other suitable linking designs may be used and coupled between the bottom plate 11 of the key switch module 1 and each press member 12 to substitute for the aforesaid scissor link design.

Further, there is a gap between each press member 12 and the membrane 31. Light may be diffused through the gap, lowering the brightness of the respective press member 12. The arrangement of the shaded portion 33 of the membrane 31 around each elastomer member 3 corresponding to each press member 12 prohibits diffusion of the light emitted by each light-emitting diode 23 of the circuit board 2 through the gap between each press member 12 and the membrane 31, enabling the light to be concentrated onto the respective press member 12.

Figure 6:
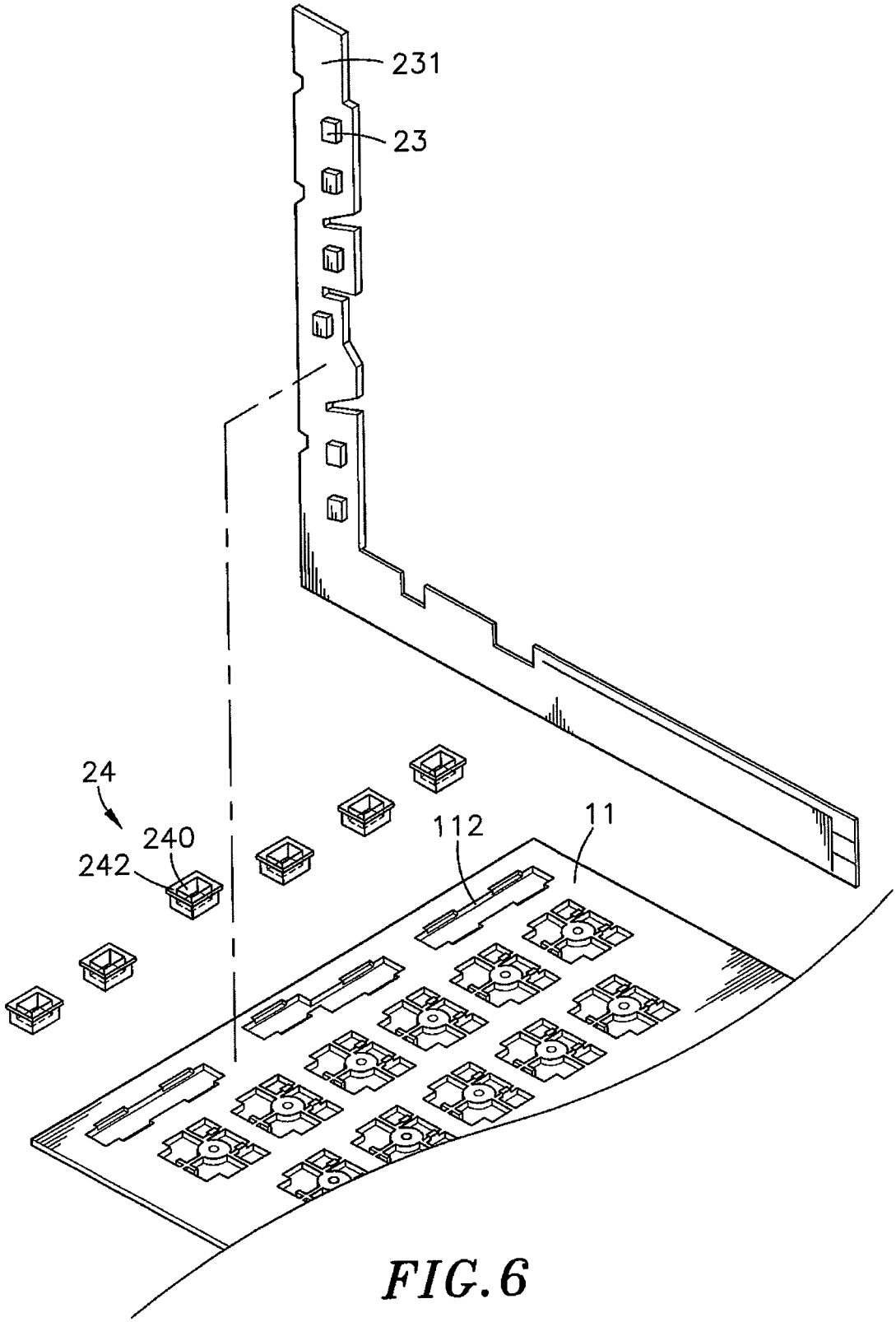
FIG. 6 is a schematic exploded view of a part of the present invention, illustrating the relationship between the flexible printed circuits, light-emitting diodes and light guide caps and the bottom plate of the key switch module.
Figure 7:
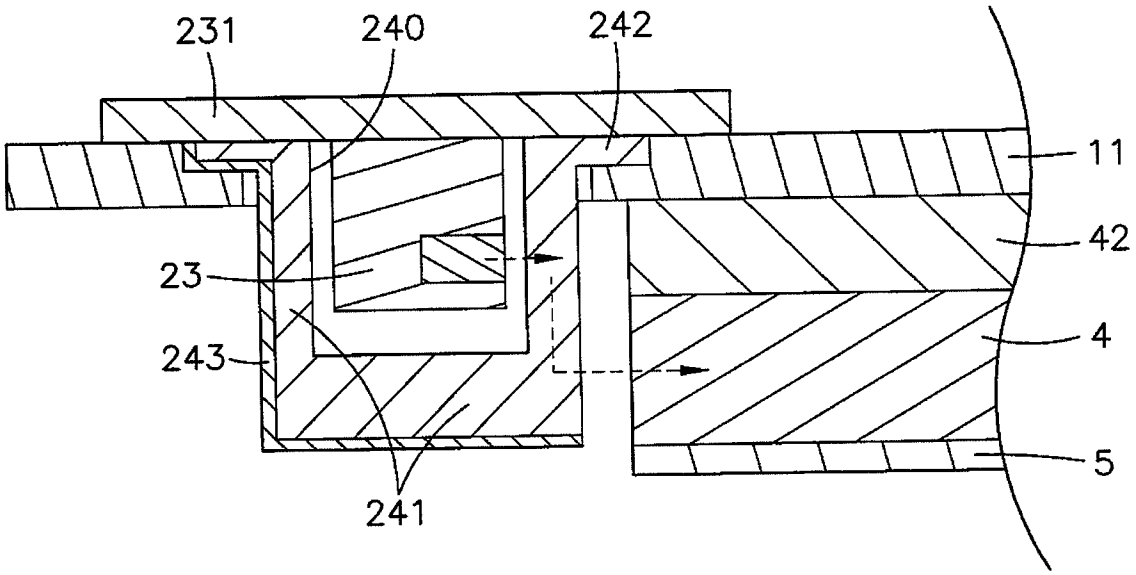
FIG. 7 is a schematic sectional view of a part of the present invention, illustrating the light-emitting diode and the associating light guide cap arranged for lateral lamination.
Figure 8:
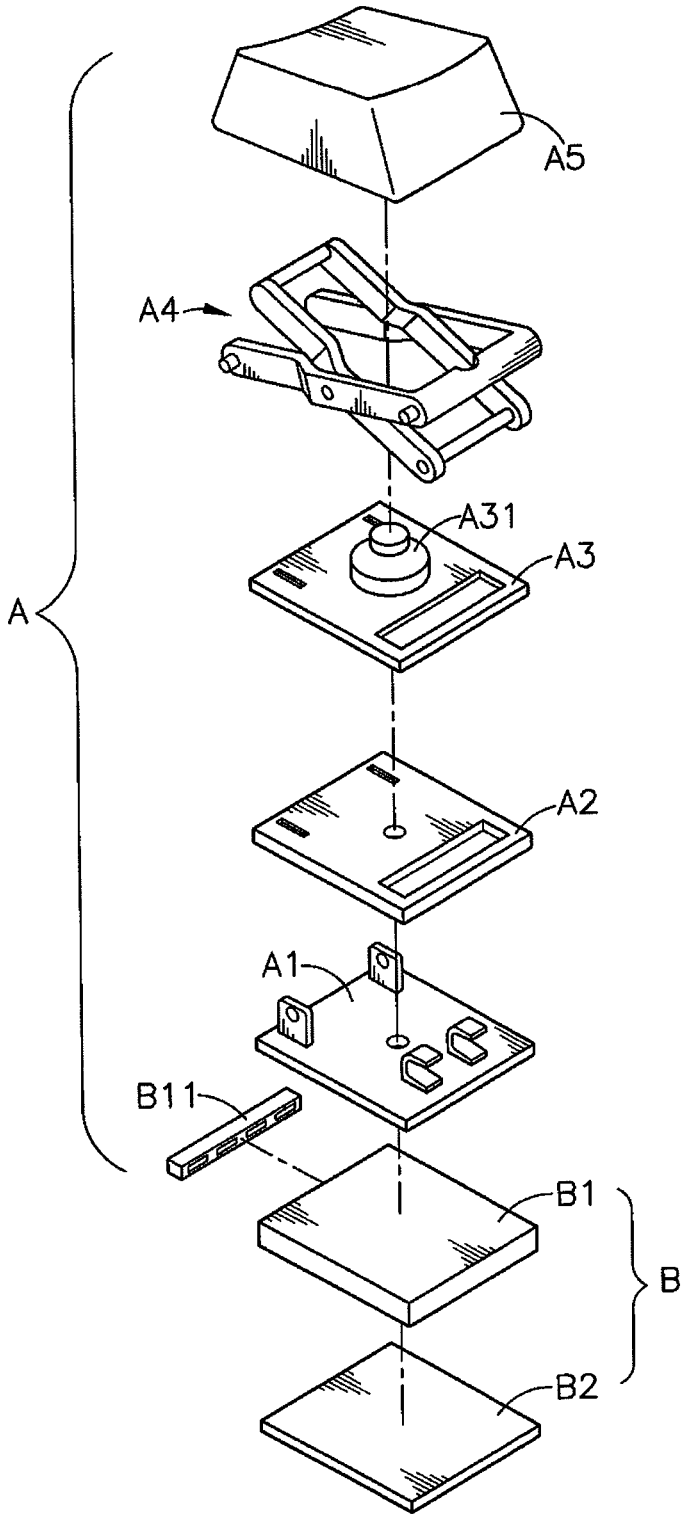
PRIOR ART FIG. 8
FIG. 8 is an exploded view of a key switch structure according to the prior art.
Figure 9:
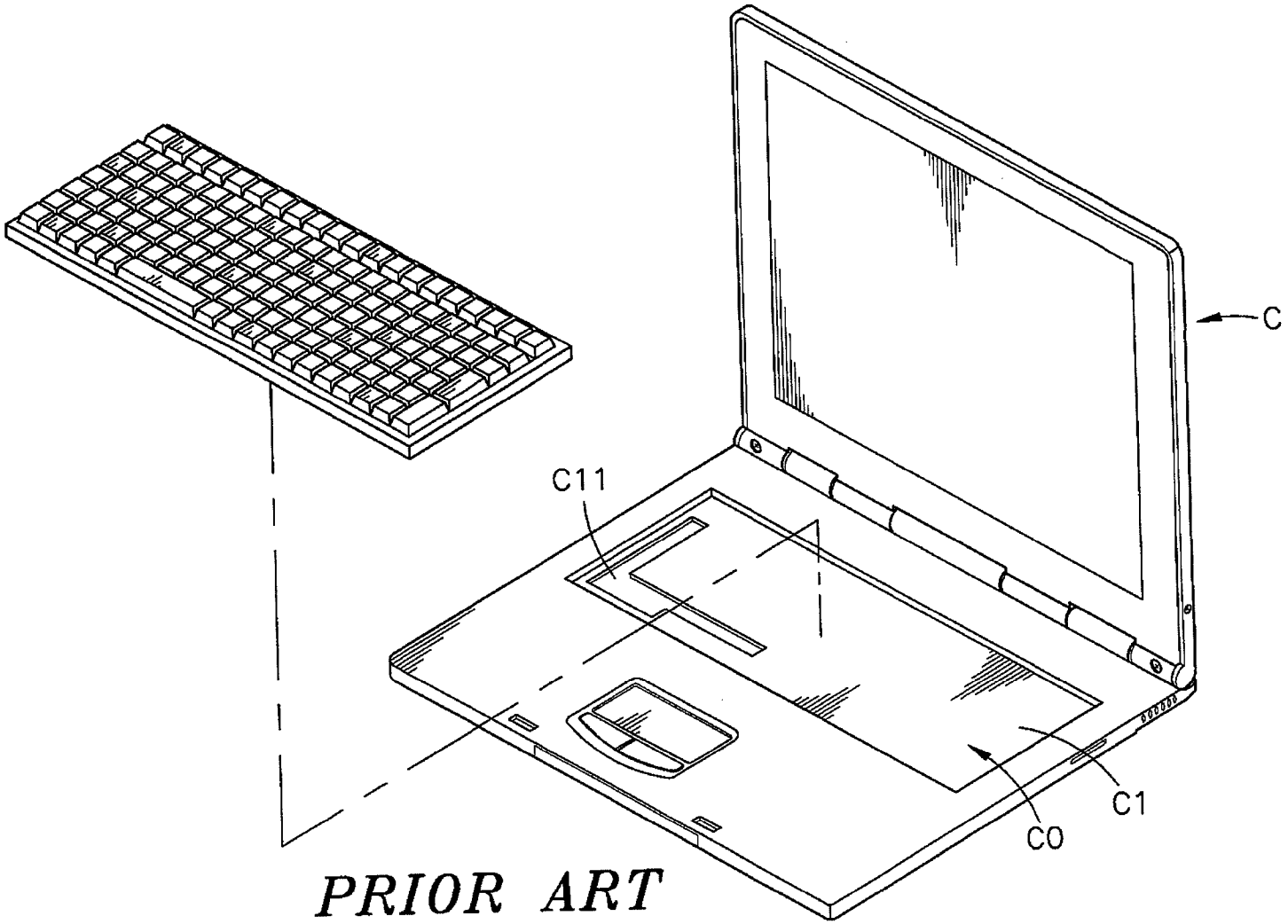
PRIOR ART FIG. 9
FIG. 9 illustrates the mounting relationship between a notebook keyboard and a notebook computer according to the prior art.

Referring to FIGS. 6 and 7 and FIGS. 1-3 again, the at least one light-emitting diode 23 are arranged at the bottom side of the flexible printed circuit layer 231 and accommodated in the accommodation chamber 240 of each respective light guide cap 24 that is arranged at or extended to the bottom side of the bottom plate 11 of the key switch module 1. When one light-emitting diode 23 is driven to give off light, the emitted light goes downwardly through the light outlet end 241 of the respective light guide cap 24 into the light guide panel 4, and then guided by the light guide panel 4 through the respective through hole 112 of the bottom plate 11 of the key switch module 1 toward the respective press member 12. Instead of the aforesaid downward arrangement, the at least one light-emitting diode 23 can be of a lateral luminous type. Further, the light guide cap 24 can be made having a top reflecting surface 2411 disposed at the top side of the light outlet end 241 for reflecting light downwardly into the light guide panel 4, and/or a reflecting layer 243 disposed around a part of the light outlet end 241 for reflecting light laterally into the light guide panel 4. By means of the functioning of the top reflecting surface 2411 and/or the reflecting layer 243, light emitted by each light-emitting diode 23 can be directed into the light guide panel 4 and uniformly guided toward the respective press member 12.

Figure 5:
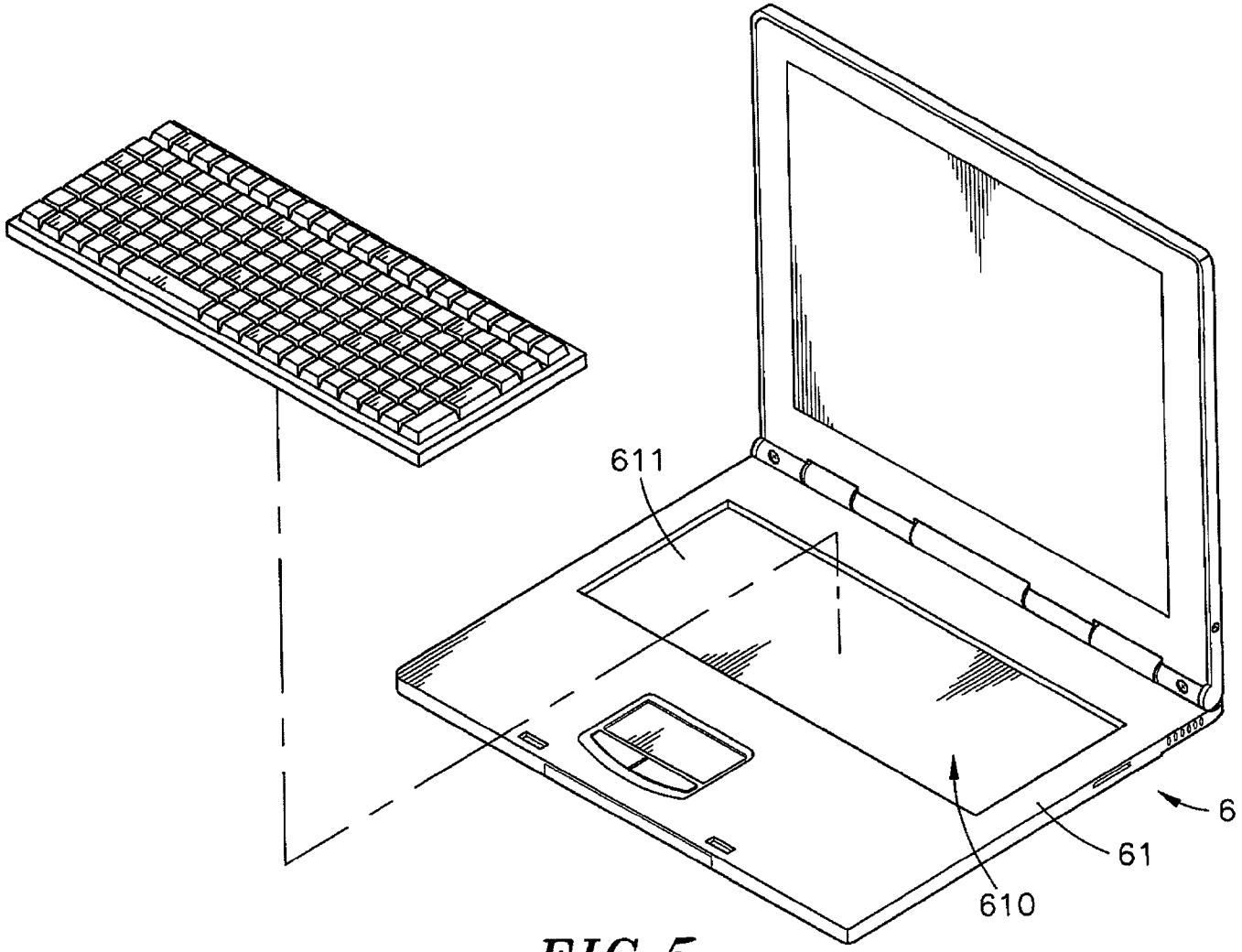
FIG. 5 is a schematic applied view of the present invention, illustrating the multicolor light-emitting computer input device made in the form of a notebook keyboard and the relationship between the multicolor light-emitting computer input device and a notebook computer.

Further, by means of the respective fixed end 242, each light guide cap 24 is bonded to the flexible printed circuit layer 231. Alternatively, the fixed end 242 of each light guide cap 24 can be bonded to the periphery of one respective through hole 112 of the bottom plate 11 of the key switch module 1 with an adhesive, avoiding permeation of outside fluid through the bottom plate 11 into the internal CPU, display card, power adapter, or any other component of the notebook computer 6 (see FIG. 5) to cause corrosion or short circuits, reducing the cost of maintenance and the possibility of failure.

Further, the press member 12 of the key switch module 1 can be made of a transparent or translucent material in the form of a key cap, thin metal sheet member or any other key member. Further, the top surface of the press member 12 can be partially coated with a layer of lacquer coating, enabling the non-coating area to show a pattern or texture that admits light. Alternatively, the top surface of the press member 12 can be wholly coated with a layer of lacquer coating, and then a laser engraving technique can be employed to remove a part of the lacquer coating from the press member 12, showing a light transmissive pattern or texture.

Referring to FIGS. 1, 2, 3 and 5 again, the multicolor light-emitting computer input device in this embodiment is a keyboard mounted in a recessed chamber 610 of a base member 61 of a notebook computer 6 and supported on a planar support frame 611 above CPU, display card, power adapter and other internal notebook components that produce heat during operation. Arranging the circuit board 2 and the light-emitting diodes 23 at the top side of the bottom plate 11 above the planar support frame 611 of the notebook computer 6, the circuit board 2 and the light-emitting diodes 23 are kept far from a high temperature environment. Further, during operation of the light-emitting diodes 23, heat can be dissipated through the bottom plate 11, prolonging the lifespan of the light-emitting diodes 23 and reducing the cost of maintenance.

Further, by means of arranging the light-emitting diodes 23 and the flexible printed circuit layer 231 at the top side of the bottom plate 11, the planar support frame 611 of the notebook computer 6 needs not to provide recesses for accommodating the light-emitting diodes 23 and the flexible printed circuit layer 231, and therefore the planar support frame 611 can be maintained having a flat, thin and uniform thickness to effectively support the multicolor light-emitting computer input device against any operating pressure, avoiding affecting the feeling of user's hand or any component deformation due to a long use.

Further, a light reflecting panel 5 can be provided at the bottom side of the light guide panel 4 to reflect light upwards, preventing light leakage and enhancing luminous brightness. Further, the top surface of the light guide panel 4 can be coated with a light transmissive protective layer 42 for protection against scratches during delivery or installation to avoid light leakages.

As stated above, the multicolor light-emitting computer input device of the present invention, in actual use, has the advantages and features as follows:

1. The circuit board 2 is arranged at the top side of the bottom plate 11 of the key switch module 1 to carry one or a number of light-emitting diodes 23 at the bottom side thereof and a light guide cap 24 around each light-emitting diode 23, enabling the light emitted by each light-emitting diode 23 to be guided by the light outlet end 241 of the respective light guide cap 24 into the light guide panel 4 and then guided by the light guide panel 4 through the respective through hole 112 of the bottom plate 11 of the key switch module 1 toward the respective press member 12. Further, by means of arranging the light-emitting diodes 23 and the circuit board 2 at the top side of the bottom plate 11, the light-emitting diodes 23 and the circuit board 2 are kept far from the high temperature area of the base member 61 of the notebook computer 6, and waste heat can be dissipated through the bottom plate 11 during operation of the multicolor light-emitting computer input device, prolonging the lifespan of the light-emitting diodes 23 and reducing the cost of maintenance.
2. The light-emitting diodes 23 can be white light-emitting diodes 23, and the light guide caps 24 can be made in one same color or different colors. Thus, the multicolor light-emitting computer input device can be selectively configured to give off different colors of light for illuminating the press members 12.
3. The light-emitting diode 23 can be selectively arranged to emit light downwardly or laterally toward the light guide panel 4; the light guide cap 24 can be configured to guide the light emitted by the associating light-emitting diode 23 downwardly or laterally into the light guide panel 4.
4. By means of arranging the light-emitting diodes 23 and the flexible printed circuit layer 231 at the top side of the bottom plate 11, the planar support frame 611 of the notebook computer 6 needs not to provide recesses for accommodating the light-emitting diodes 23 and the flexible printed circuit layer 231, and therefore the planar support frame 611 can be maintained having a flat, thin and uniform thickness to effectively support the multicolor light-emitting computer input device against any operating pressure, avoiding affecting the feeling of user's hand or any component deformation due to a long use.

5. The fixed end 242 of each light guide cap 24 can be bonded to the periphery of one respective through hole 112 of the bottom plate 11 of the key switch module 1 with an adhesive, avoiding permeation of outside fluid through the bottom plate 11 into the internal CPU, display card, power adapter, or any other component of the notebook computer 6 to cause corrosion or short circuits, reducing the cost of maintenance and the possibility of failure.

In conclusion, the multicolor light-emitting computer input device of the present invention is characterized in that by means of arranging the light-emitting diodes 23 and the circuit board 2 at the top side of the bottom plate 11, the light-emitting diodes 23 and the circuit board 2 are kept far from the high temperature area of the base member 61 of the notebook computer 6, and waste heat can be dissipated through the bottom plate 11 during operation of the multicolor light-emitting computer input device, prolonging the lifespan of the light-emitting diodes 23 and reducing the cost of maintenance; the light-emitting diode(s) 23 can be a white light-emitting diode 23, and the light guide cap(s) 24 can be made in any of a variety of colors so that the multicolor light-emitting computer input device can be selectively configured to give off different colors of light for illuminating the press member(s) 12.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A multicolor light-emitting computer input device, comprising:

a key switch module comprising a bottom plate having a plurality of through holes, at least one press member spaced above said bottom plate, and at least one linking member respectively coupled between said bottom plate and said at least one press member for moving said at least one press member up and down relative to said bottom plate;

a circuit board arranged at a top side of said bottom plate, comprising at least one light-emitting diode electrically bonded to a flexible printed circuit layer thereof corresponding to the at least one through hole of said bottom plate of said key switch module, and at least one light guide cap respectively inserted through the at least one through hole of said bottom plate and capped on said at least one light-emitting diode;

at least one elastomer member arranged at a top side of said circuit board; and a light guide panel arranged at a bottom side of said bottom plate of said key switch module for receiving light from said at least one light-emitting diode and said at least one light guide cap and guiding the received light toward said at least one press member of said key switch module, said light guide panel comprising at least one receiving hole for accommodating said at least one light guide cap respectively.

2. The multicolor light-emitting computer input device as claimed in claim 1, wherein said bottom plate of said key switch module is selected from the material group of metals having high thermal conductivity and hard plastics.

3. The multicolor light-emitting computer input device as claimed in claim 1, wherein said bottom plate comprises at least one set of upright coupling lugs; each said press member comprises two coupling portions bilaterally disposed at a bottom side thereof; each said linking member is a scissor link having pivot portions respectively pivotally coupled to the coupling portions of one said press member and one respective set of said upright coupling lugs of said bottom plate; said circuit board comprises a plurality of through holes for the passing of said at least one set of upright coupling lugs of said bottom plate; said at least one elastomer member has a bottom side thereof formed integrally with a membrane, said membrane comprising at least one set of through holes for the passing of said at least one set of upright coupling lugs of said bottom plate of said key switch module.

4. The multicolor light-emitting computer input device as claimed in claim 1, wherein said at least one elastomer member has a bottom side thereof formed integrally with a membrane, said membrane comprising at least one set of through holes for the passing of said at least one set of upright coupling lugs of said bottom plate of said key switch module, said membrane comprising a shaded portion disposed around each said elastomer member corresponding to each said press member for blocking light.

5. The multicolor light-emitting computer input device as claimed in claim 1, wherein said at least one press member is made in one of the forms of key cap, thin metal sheet member and key member.

6. The multicolor light-emitting computer input device as claimed in claim 1, wherein said circuit board is a membrane circuit board comprising two substrates selected from the material group of polycarbonate, polyethylene terephthalate and flexible light transmissive sheet materials, a circuit layout arranged between said two substrates, and flexible printed circuit layer arranged at a bottom side thereof.

7. The multicolor light-emitting computer input device as claimed in claim 1, further comprising a light reflecting panel light arranged at a bottom side of said light guide panel for reflecting light upwards.

8. The multicolor light-emitting computer input device as claimed in claim 1, wherein said light guide panel comprises a light transmissive protective layer coated on a top surface thereof for protection against scratches.

9. The multicolor light-emitting computer input device as claimed in claim 1, wherein said at least one light-emitting diode is disposed at a center area of said bottom plate of said key switch module.

10. The multicolor light-emitting computer input device as claimed in claim 1, wherein said at least one light-emitting diode and said flexible printed circuit layer are disposed at one lateral side relative to said bottom plate of said key switch module.

11. The multicolor light-emitting computer input device as claimed in claim 1, wherein each said light guide cap comprises an accommodation chamber for accommodating one said light-emitting diode, a light outlet end formed of bottom and peripheral walls thereof, and a fixed end disposed at a top side thereof.

12. The multicolor light-emitting computer input device as claimed in claim 1, wherein each said light guide cap comprises a top reflecting surface disposed at a top side of a light outlet end thereof for reflecting light downwardly into said light guide panel.

13. The multicolor light-emitting computer input device as claimed in claim 1, wherein each said light guide cap comprises a reflecting layer disposed around a part of a light outlet end thereof for reflecting light laterally into said light guide panel.

* * * * *